US010104973B1

(12) United States Patent
Guerrier

(10) Patent No.: US 10,104,973 B1
(45) Date of Patent: Oct. 23, 2018

(54) SHADING ASSEMBLY

(71) Applicant: Kevin Guerrier, Chicago, IL (US)

(72) Inventor: Kevin Guerrier, Chicago, IL (US)

( * ) Notice: Subject to any disclaimer, the term of this patent is extended or adjusted under 35 U.S.C. 154(b) by 0 days.

(21) Appl. No.: 15/473,216

(22) Filed: Mar. 29, 2017

(51) Int. Cl.

| | |
|---|---|
| ***A47C 7/66*** | (2006.01) |
| ***A47C 1/14*** | (2006.01) |
| ***A47C 4/28*** | (2006.01) |
| ***A47C 7/54*** | (2006.01) |

(52) U.S. Cl.
CPC ..... *A47C 7/66* (2013.01); *A47C 1/14* (2013.01); *A47C 4/283* (2013.01); *A47C 7/54* (2013.01)

(58) Field of Classification Search
CPC .... A47C 7/66; A47C 7/54; A47C 1/14; A47C 4/283
USPC ..... 297/184.1, 184.11, 184.14, 184.15
See application file for complete search history.

(56) References Cited

U.S. PATENT DOCUMENTS 946,761 A * 1/1910 Luelf ..... B60J 11/00 297/184.11 X
2,050,492 A * 8/1936 Lassiter ..... A47C 7/66 297/184.14 X
2,109,881 A 3/1938 Goldberg
2,752,929 A * 7/1956 Berger ..... A47C 7/66 297/184.15 X
2,771,125 A * 11/1956 Dobbins ..... A47C 1/146 297/184.15 X
2,811,977 A * 11/1957 McClish ..... E04H 15/001 297/184.14 X
3,027,189 A * 3/1962 Scott ..... E04H 15/001 297/184.14 X
3,131,704 A * 5/1964 Shimon ..... E04H 15/001 297/184.14 X
3,155,427 A * 11/1964 Necessary ..... A47C 1/16 297/184.14 X
3,509,891 A * 5/1970 Bolt ..... A01K 97/01 297/184.14 X
3,768,860 A * 10/1973 Barker ..... A47B 43/04 297/184.14 X
3,799,608 A * 3/1974 Smutny ..... E04H 1/1205 297/184.14 X
3,845,985 A * 11/1974 Behrend ..... A47C 7/66 297/184.14
3,865,429 A * 2/1975 Barker ..... E04H 1/1205 297/184.14 X
3,879,086 A * 4/1975 Moceri ..... A45B 11/00 297/184.14 X
4,083,601 A * 4/1978 McBeth ..... A47C 7/66 297/184.14 X
4,754,987 A * 7/1988 Williams ..... A61G 5/00 297/184.14 X
4,788,997 A * 12/1988 Clopton ..... E04H 15/001 297/184.14 X
5,154,473 A * 10/1992 Joranco ..... A47C 7/66 297/184.15 X (Continued)

FOREIGN PATENT DOCUMENTS

GB 2025763 A * 1/1980 ..... A47C 7/66
GB 2052960 A * 2/1981 ..... A47C 4/52
WO WO2011139679 11/2011

*Primary Examiner* — Rodney B White

(57) ABSTRACT

A shading assembly for a chair includes a frame that is configured to couple to a chair, such as a beach chair and a lawn chair. A panel is configured to position over the frame and to couple to the chair. The panel is flexible and substantially impenetrable to light. The panel is configured to shade a user of the chair.

16 Claims, 5 Drawing Sheets

(56) References Cited

U.S. PATENT DOCUMENTS 5,168,889 A * 12/1992 Diestel ..... A47C 7/66 297/184.15 X
5,171,059 A * 12/1992 Patrick ..... A47C 7/66 297/184.14 X
5,203,363 A * 4/1993 Kidwell ..... A47C 7/66 297/184.15 X
5,833,310 A * 11/1998 Labelle ..... A47C 7/66 297/184.1 X
5,873,625 A * 2/1999 Uchtman ..... A47C 4/04 297/184.15
5,967,601 A * 10/1999 Gillins ..... A47C 7/66 297/184.1 X
6,296,002 B1 * 10/2001 Tashchyan ..... A47C 4/283 297/184.1 X
6,371,553 B1 * 4/2002 Tang ..... A47C 4/286 297/184.1
6,789,557 B1 * 9/2004 Wahl, Jr. ..... A47C 7/66 297/184.11
6,908,148 B2 * 6/2005 Wang ..... B60N 2/26 297/184.11
7,243,990 B1 * 7/2007 Wahl ..... A47C 7/66 297/184.15
7,311,355 B2 * 12/2007 Fargason, III ..... A01K 97/01 297/184.1 X
7,374,238 B2 * 5/2008 Lingwall ..... A47C 4/52 297/184.11 X
7,600,812 B2 * 10/2009 Godbout ..... A01K 97/01 297/184.15 X
7,648,196 B2 * 1/2010 Degelman ..... A47C 4/286 297/184.1 X
7,740,310 B1 * 6/2010 Forster ..... A47C 7/66 297/184.1 X
7,753,063 B1 * 7/2010 Laws ..... A47C 7/66 297/184.15 X
8,534,752 B2 * 9/2013 Martin ..... A47B 3/06 297/194.15 X
8,991,411 B1 * 3/2015 Neuman ..... A47C 29/00 297/184.11 X
8,997,770 B1 * 4/2015 Martin ..... A47C 7/66 297/184.15 X
9,049,938 B2 6/2015 Reeb et al.
D737,066 S 8/2015 Lovley, II et al.
9,795,526 B2 * 10/2017 Davis ..... A61G 5/10
2004/0075309 A1 * 4/2004 Samaha ..... A47C 7/66 297/184.11
2006/0054207 A1 3/2006 Wootliff
2006/0284457 A1 * 12/2006 Holley ..... A47C 5/10 297/184.15
2007/0187999 A1 * 8/2007 Zapater ..... A47C 1/14 297/184.15
2008/0018146 A1 * 1/2008 Wahl ..... A47C 7/66 297/184.15
2008/0272640 A1 11/2008 Boyle et al.
2008/0284217 A1 * 11/2008 Noonan ..... A47C 7/66 297/184.11
2009/0039685 A1 * 2/2009 Zernov ..... A47C 7/66 297/184.14 X
2009/0218856 A1 * 9/2009 Sykes ..... A47C 4/286 297/184.15
2010/0045081 A1 * 2/2010 Efthimiou ..... A47C 7/66 297/184.11
2010/0102600 A1 * 4/2010 Lovley, II ..... A47C 7/66 297/184.15
2011/0175407 A1 * 7/2011 Sharapov ..... A47C 1/14 297/184.15
2011/0181078 A1 * 7/2011 Kelly ..... A47C 4/286 297/184.1 X
2011/0284045 A1 11/2011 Reeb et al.
2013/0069400 A1 * 3/2013 Nikolic ..... A47C 4/286 297/184.15
2014/0132041 A1 5/2014 Manus
2016/0058638 A1 * 3/2016 Davis ..... A61G 5/10 297/184.14 X

* cited by examiner

SHADING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including information disclosed under 37 CFR 1.97 and 1.98

The disclosure and prior art relates to shading assemblies and more particularly pertains to a new shading assembly for a chair.

BRIEF SUMMARY OF THE INVENTION

An embodiment of the disclosure meets the needs presented above by generally comprising a frame that is configured to couple to a chair, such as a beach chair and a lawn chair. A panel is configured to position over the frame and to couple to the chair. The panel is flexible and substantially impenetrable to light. The panel is configured to shade a user of the chair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
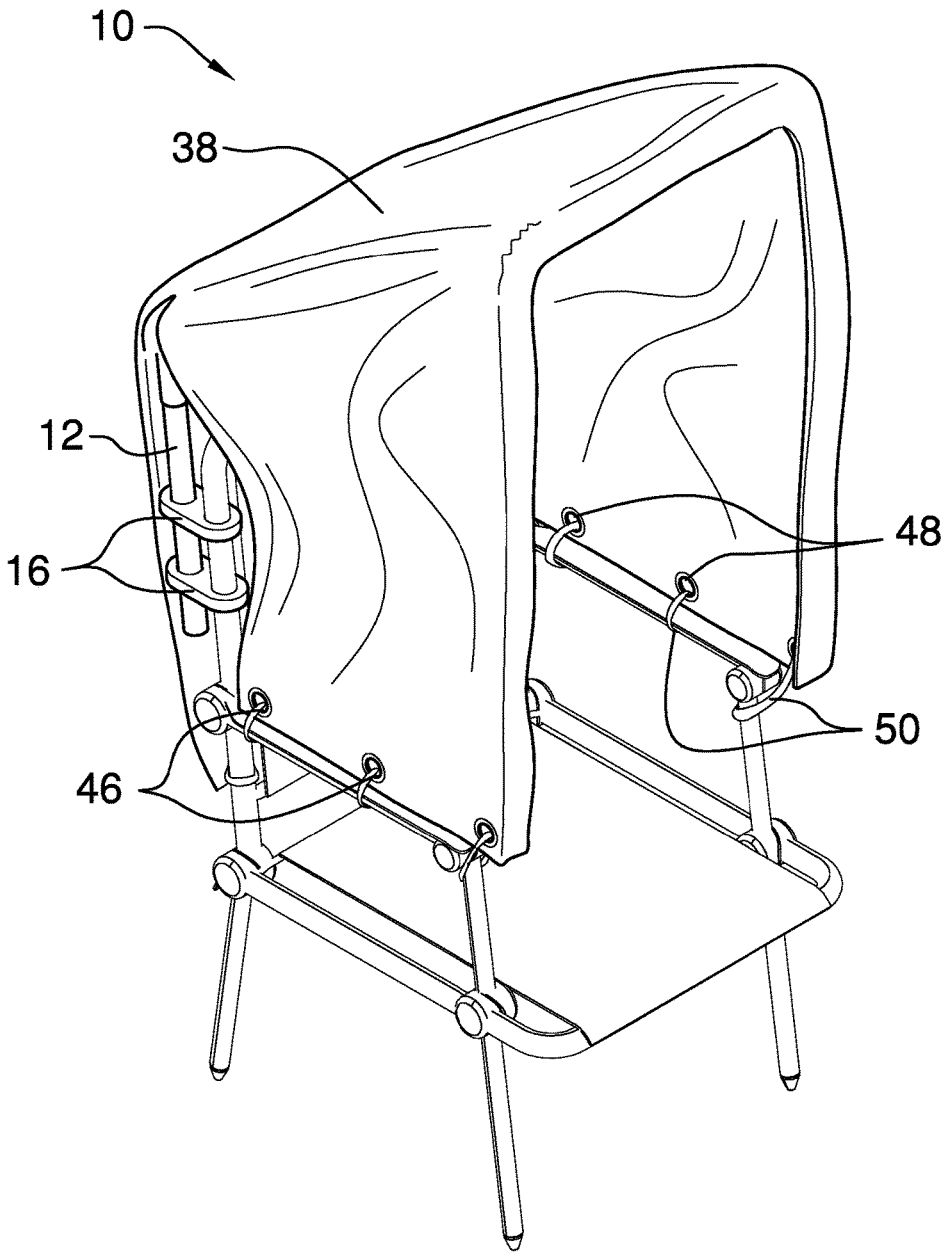
FIG. 1 is an isometric perspective view of a shading assembly according to an embodiment of the disclosure.
Figure 2:
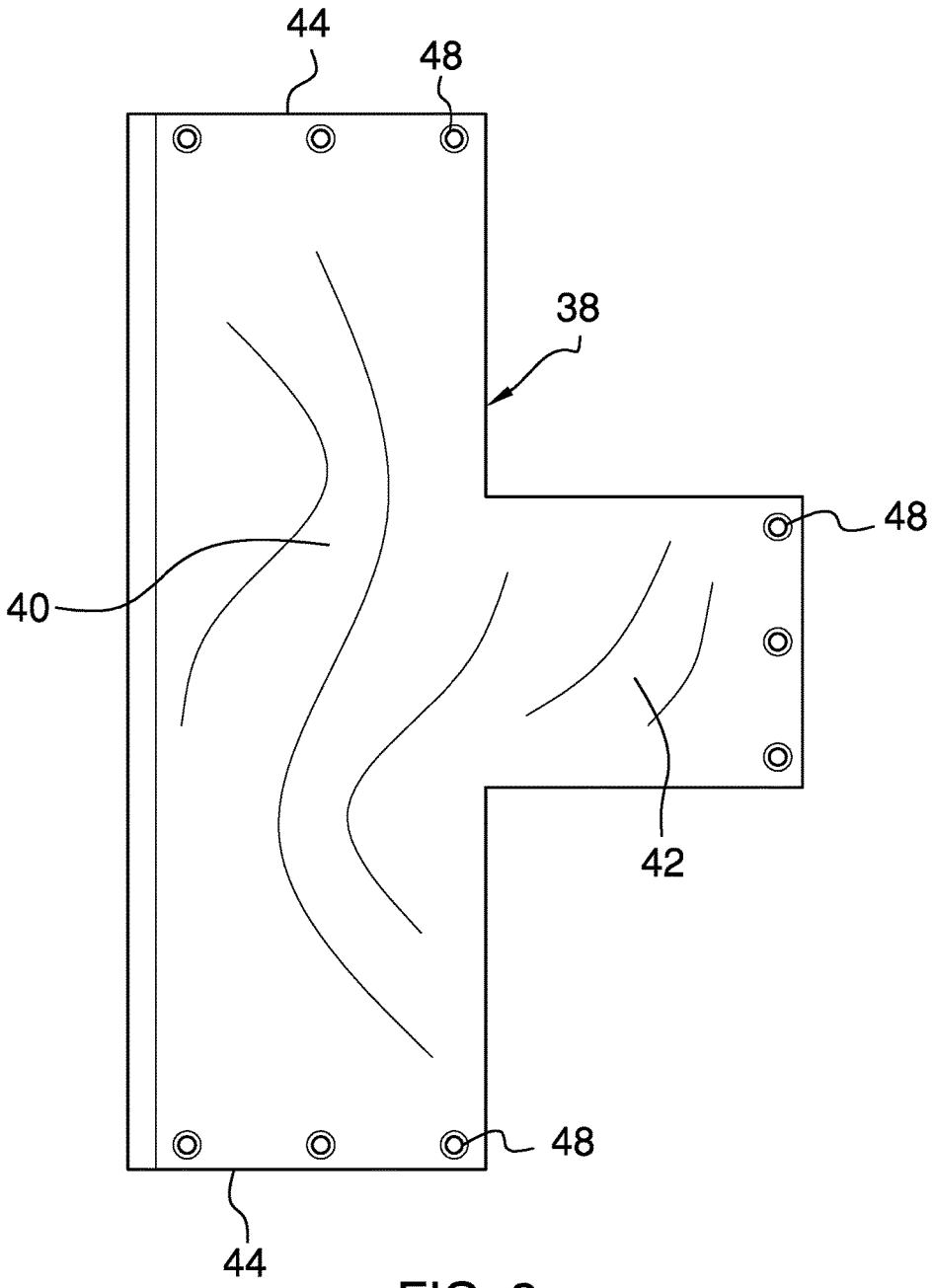
FIG. 2 is a top view of an embodiment of the disclosure.
Figure 3:
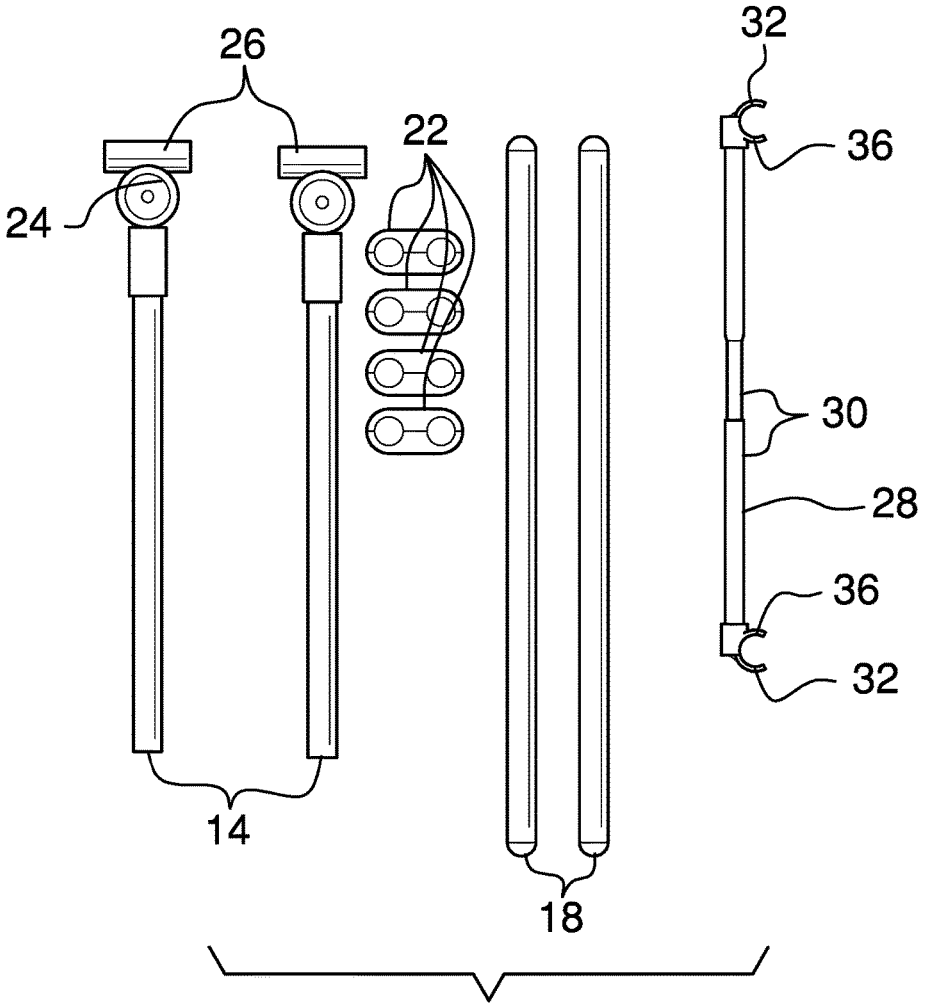
FIG. 3 is an exploded view of an embodiment of the disclosure.
Figure 4:
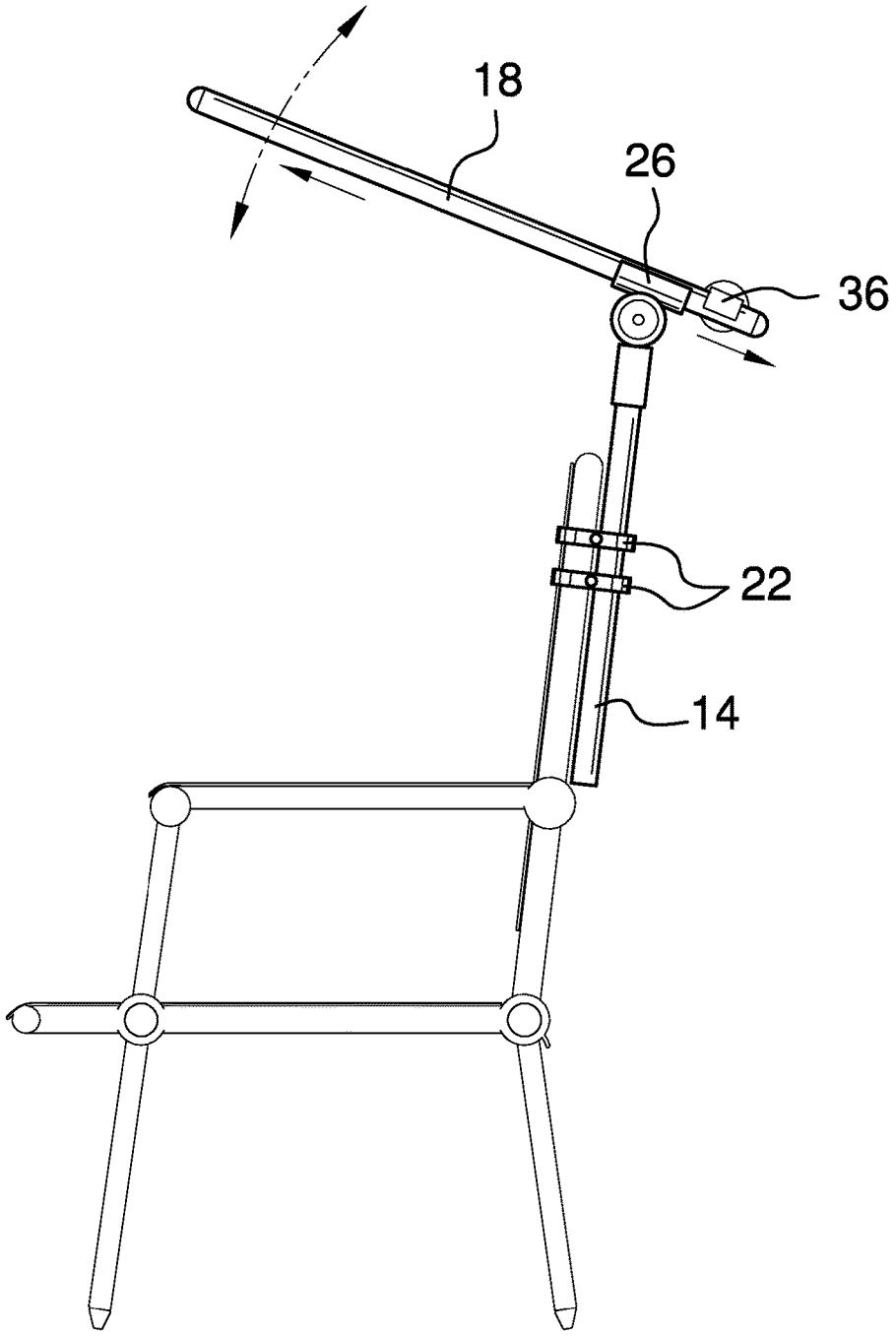
FIG. 4 is a side view of an embodiment of the disclosure.
Figure 5:
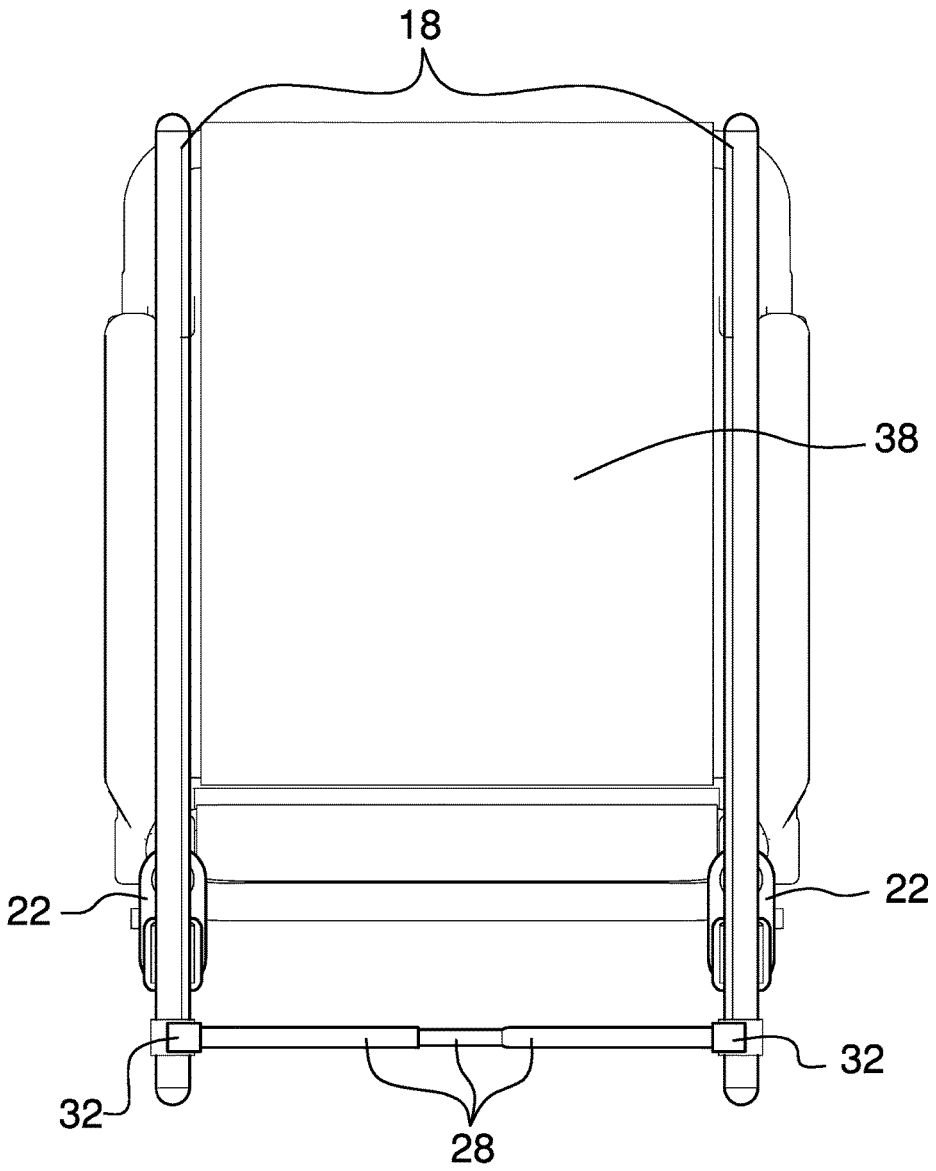
FIG. 5 is a top view of an embodiment of the disclosure.

With reference now to the drawings, and in particular to FIGS. 1 through 5 thereof, a new shading assembly embodying the principles and concepts of an embodiment of the disclosure and generally designated by the reference numeral 10 will be described.

As best illustrated in FIGS. 1 through 5, the shading assembly 10 generally comprises a frame 12 that is configured to couple to a chair, such as a beach chair and a lawn chair. In one embodiment, the frame 12 comprises a pair of first rods 14, a plurality of first connectors 16, and a pair of second rods 18. The first connectors 16 are configured to couple the first rods 14 singly to the back supports of the chair. Each second rod 18 is coupled to and extends from an upper end 20 of a respective first rod 14. The second rods 18 are positioned on the first rods 14 so that each second rod 18 extends over a respective arm of the chair.

In another embodiment, the first rods 14 and the second rods 18 are circularly shaped when viewed longitudinally. In yet another embodiment, the first connectors 16 comprises billet clamps 22. In still yet another embodiment, the plurality of first connectors 16 comprises four first connectors 16 that are positioned two apiece on each first rod 14.

Each of a pair of couplers 24 is coupled to the upper end 20 of the respective first rod 14. Each coupler 24 is configured to couple to a respective second rod 18 to couple the respective second rod 18 to the respective first rod 14. The respective second rod 18 is positioned above the respective arm of the chair.

In one embodiment, the couplers 24 comprise tubes 26. The tubes 26 are substantially complementary to the second rods 18. The tubes 26 are positioned on the first rods 14 such that each tube 26 is positioned to insert a respective second rod 18 to slidably couple the respective second rod 18 to a respective first rod 14. In another embodiment, the tubes 26 are pivotally connected to the first rods 14.

A third rod 28 is coupled to and extends between the second rods 18. The third rod 28 is positioned proximate to the upper ends 20 of the first rods 14. The third rod 28 is positioned to deter horizontal movement of the second rods 18. In one embodiment, the third rod 28 is circularly shaped when viewed longitudinally. In another embodiment, the third rod 28 comprises a pair of nested sections 30 so that the third rod 28 is selectively extensible.

Each of a pair of second connectors 32 is coupled to a respective opposing end 34 of the third rod 28. Each second connector 32 is configured to couple to a respective second rod 18. The second connectors 32 are positioned on the third rod 28 such that each second connector 32 is positioned to couple to the respective second rod 18 to couple the third rod 28 to the second rods 18. In one embodiment, the second connectors 32 comprise clips 36. The clips 36 are C-shaped and deformable.

A panel 38 is configured to position over the frame 12 and to couple to the chair. The panel 38 is flexible and substantially impenetrable to light. The panel 38 is positioned on the frame 12 so that the panel 38 is configured to shade a user of the chair. In one embodiment, the panel 38 comprises a first section 40 and a second section 42. The first section 40 is substantially rectangularly shaped. The first section 40 is configured to position between the arms of the chair and over the second rods 18. The second section 42 is coupled to and extends from the first section 40 equally distant from opposing edges 44 of the first section 40. The second section 42 is configured to position between the first section 40 and a back edge of the seat of the chair.

A plurality of fasteners 46 is coupled to a perimeter of the panel 38. The fasteners 46 are configured to couple the panel 38 to the chair. In one embodiment, each fastener 46 comprises a grommet 48 and a zip tie 50. The grommets 48 are positioned in the panel 38 such that each grommet 48 is positioned to loopedly insert a respective zip tie 50. The respective zip tie 50 is positioned around a support of the chair to couple the panel 38 to the chair. In another embodiment, the plurality of fasteners 46 comprises nine fasteners 46 that are positioned three-apiece proximate to each opposing edge 44 of the first section 40 and in the second section 42 distal from the first section 40.

In use, the billet clamps 22 that are positioned on the first rods 14 are configured to couple the first rods 14 singly to the back supports of the chair. The tubes 26 that are positioned on the first rods 14 are each positioned to insert a respective second rod 18 to slidably couple the respective second rod 18 to a respective first rod 14. The clips 36 that are positioned on said third rod 28 are positioned to couple singly to the second rods 18 to couple the third rod 28 to the second rods 18. The third rod 28 is positioned to deter horizontal movement of the second rods 18. The tubes 26 are pivotally coupled to the first rods 14 so that the second rods 18 are selectively positionable relative to the arms of the chair. The grommets 48 that are positioned in the panel 38 are each positioned to loopedly inserting a respective zip tie 50. The respective zip tie 50 is positioned around a support of the chair to couple the panel 38 to the chair. The panel 38 is configured to shade the user of the chair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shading assembly comprising:

a frame configured for coupling to a chair;

a panel configured for positioning over said frame and for coupling to the chair, said panel being flexible, said panel being substantially impenetrable to light, said panel comprising a first section and a second section, said first section being substantially rectangularly shaped such that said first section is positionable to extend over said frame wherein opposing edges of said first section are configured for positioning adjacent to respective arms of the chair; and a plurality of fasteners, said plurality of fasteners including respective sets of at least three said fasteners being positioned in spaced arrangement along each of said opposing edges of said first section wherein said sets of at least three fasteners are configured for coupling said panel to the arms of the chair.

2. The assembly of claim 1, further including said frame comprising:

a pair of first rods;

a plurality of first connectors, each said first connector being configured for coupling to a respective said first rod to a respective back support of the chair;

a pair of second rods, each said second rod being coupled to and extending from an upper end of a respective said first rod; and wherein said first connectors are positioned on said first rods such that said first connectors are configured for coupling said first rods singly to the back supports of the chair, wherein said second rods are positioned on said first rods such that each said second rod extends over a respective arm of the chair.

3. The assembly of claim 2, further including said first connectors comprising billet clamps.

4. The assembly of claim 2, further including said plurality of first connectors comprising four said first connectors positioned two apiece on each said first rod.

5. The assembly of claim 2, further including a pair of couplers, each said coupler being coupled to said upper end of said respective said first rod, each said coupler being configured for coupling to a respective said second rod for coupling said respective said second rod to a respective said first rod for positioning said respective said second rod above the respective arm of the chair.

6. The assembly of claim 5, further including said couplers comprising tubes, said tubes being substantially complementary to said second rods, wherein said tubes are positioned on said first rods such that each said tube is positioned for inserting a respective said second rod for slidably coupling said respective said second rod to a respective said first rod.

7. The assembly of claim 6, further including said tubes being pivotally connected to said first rods.

8. The assembly of claim 2, further including a third rod coupled to and extending between said second rods, said third rod being positioned proximate to said upper ends of said first rods, wherein said third rod is positioned on said second rods such that said third rod is positioned for deterring horizontal movement of said second rods.

9. The assembly of claim 8, further including said third rod being circularly shaped when viewed longitudinally.

10. The assembly of claim 8, further including said third rod comprising a pair of nested sections such that said third rod is selectively extensible.

11. The assembly of claim 8, further including a pair of second connectors, each said second connector being coupled to a respective opposing end of said third rod, each said second connector being configured for coupling to a respective said second rod, wherein said second connectors are positioned on said third rod such that each said second connector is positioned for coupling to said respective said second rod for coupling said third rod to said second rods.

12. The assembly of claim 11, further including said second connectors comprising clips, said clips being C-shaped, said clips being deformable.

13. The assembly of claim 2, further including said panel comprising a second section, said second section being coupled to and extending from said first section equally distant from said opposing edges of said first section such that said second section is configured for positioning between said first section and a back edge of the seat of the chair.

14. The assembly of claim 2, further including said first rods being and said second rods being circularly shaped when viewed longitudinally.

15. The assembly of claim 1, further including each said fastener comprising a grommet and a zip tie, wherein said grommets are positioned in said panel such that each said grommet is positioned for loopedly inserting a respective said zip tie such that said respective said zip tie is positioned around a support of the chair for coupling said panel to the chair.

16. A shading assembly comprising:

a frame configured for coupling to a chair, said frame comprising:

a pair of first rods, said first rods being circularly shaped when viewed longitudinally, a plurality of first connectors, each said first connector being configured for coupling to a respective said first rod to a respective back support of the chair, wherein said first connectors are positioned on said first rods such that said first connectors are configured for coupling said first rods singly to the back supports of the chair, said first connectors comprising billet clamps, said plurality of first connectors comprising four said first connectors positioned two apiece on each said first rod, a pair of second rods, each said second rod being coupled to and extending from an upper end of a respective said first rod, wherein said second rods are positioned on said first rods such that each said second rod extends over a respective arm of the chair, said second rods being circularly shaped when viewed longitudinally a pair of couplers, each said coupler being coupled to said upper end of said respective said first rod, each said coupler being configured for coupling to a respective said second rod for coupling said respective said second rod to a respective said first rod for positioning said respective said second rod above the respective arm of the chair, said couplers comprising tubes, said tubes being substantially complementary to said second rods, wherein said tubes are positioned on said first rods such that each said tube is positioned for inserting a respective said second rod for slidably coupling said respective said second rod to a respective said first rod, said tubes being pivotally connected to said first rods, a third rod coupled to and extending between said second rods, said third rod being positioned proximate to said upper ends of said first rods, wherein said third rod is positioned on said second rods such that said third rod is positioned for deterring horizontal movement of said second rods, said third rod being circularly shaped when viewed longitudinally, said third rod comprising a pair of nested sections such that said third rod is selectively extensible, and a pair of second connectors, each said second connector being coupled to a respective opposing end of said third rod, each said second connector being configured for coupling to a respective said second rod, wherein said second connectors are positioned on said third rod such that each said second connector is positioned for coupling to said respective said second rod for coupling said third rod to said second rods, said second connectors comprising clips, said clips being C-shaped, said clips being deformable;

a panel configured for positioning over said frame and for coupling to the chair, said panel being flexible, said panel being substantially impenetrable to light, wherein said panel is positioned on said frame such that said panel is configured for shading a user of the chair, said panel comprising a first section and a second section, said first section being substantially rectangularly shaped such that said first section is positionable to extend over said frame wherein opposing edges of said first section are configured for positioning adjacent to respective arms of the chair, said second section being coupled to and extending from said first section equally distant from opposing edges of said first section such that said second section is configured for positioning between said first section and a back edge of the seat of the chair;

a plurality of fasteners, said plurality of fasteners including respective sets of at least three said fasteners being positioned in spaced arrangement along each of said opposing edges of said first section wherein said sets of at least three fasteners are configured for coupling said panel to the arms of the chair, each said fastener comprising a grommet and a zip tie, wherein said grommets are positioned in said panel such that each said grommet is positioned for loopedly inserting a respective said zip tie such that said respective said zip tie is positioned around a support of the chair for coupling said panel to the chair; and wherein said billet clamps are positioned on said first rods such that said billet clamps are configured for coupling said first rods singly to the back supports of the chair, wherein said tubes are positioned on said first rods such that each said tube is positioned for inserting said respective said second rod for slidably coupling said respective said second rod to said respective said first rod, wherein said tubes are pivotally coupled to said first rods such that said second rods are selectively positionable relative to the arms of the chair, wherein said clips are positioned on said third rod such that each said clip is positioned for coupling to said respective said second rod for coupling said third rod to said second rods such that said third rod is positioned for deterring horizontal movement of said second rods, wherein said grommets are positioned in said panel such that each said grommet is positioned for loopedly inserting said respective said zip tie such that said respective said zip tie is positioned around a support of the chair for coupling said panel to the chair, such that said panel is configured for shading the user of the chair.

* * * * *